US008558747B2

(12) United States Patent
Lytle et al.

(10) Patent No.: US 8,558,747 B2
(45) Date of Patent: Oct. 15, 2013

(54) BROADBAND CLOVER LEAF DIPOLE PANEL ANTENNA

(75) Inventors: Gary M. Lytle, Portland, ME (US); John L. Schadler, Raymond, ME (US); David Kokotoff, Alpharetta, GA (US)

(73) Assignee: Dielectric, LLC, Raymond, ME (US)

( * ) Notice: Subject to any disclaimer, the term of this patent is extended or adjusted under 35 U.S.C. 154(b) by 402 days.

(21) Appl. No.: 12/910,079

(22) Filed: Oct. 22, 2010

(65) Prior Publication Data

US 2012/0098725 A1 Apr. 26, 2012

(51) Int. Cl.
*H01Q 21/26* (2006.01)

(52) U.S. Cl.
USPC ..... 343/797; 343/795

(58) Field of Classification Search
USPC ..... 343/795, 797, 821
See application file for complete search history.

(56) References Cited

U.S. PATENT DOCUMENTS

| | | | | |
|---|---|---|---|---|
| 4,510,501 | A * | 4/1985 | Woodward et al. | 343/742 |
| 2005/0162332 | A1* | 7/2005 | Schantz | 343/795 |
| 2007/0008236 | A1* | 1/2007 | Tillery et al. | 343/797 |
| 2007/0254587 | A1 | 11/2007 | Schadler et al. | |
| 2012/0146871 | A1* | 6/2012 | Choi et al. | 343/795 |

* cited by examiner

*Primary Examiner* — Hoanganh Le
(74) *Attorney, Agent, or Firm* — Baker & Hostetler LLP

(57) ABSTRACT

An antenna radiator is provided. The radiator includes four elements, each including a node, a first ring connected to the node, and a second ring connected to the node and disposed inside of and coplanar with the first ring. The first ring includes a first plurality of segments, and the second ring includes a second plurality of segments.

20 Claims, 5 Drawing Sheets

BROADBAND CLOVER LEAF DIPOLE PANEL ANTENNA

FIELD OF THE INVENTION

The present invention relates generally to electromagnetic signal antenna elements. More particularly, the present invention relates to directional radio frequency (RF) antenna radiators for low- to medium-power broadcasting, where the radiators are configurable to support single- or dual-feed and linear or elliptical, e.g., circular, polarization.

BACKGROUND OF THE INVENTION

In hybrid-coupled crossed-dipole radiators, balun-coupled loops, which are typically coplanar, convex, conductive, and substantially continuous, are arranged in a square layout. Each loop has two end-to-end connected, equal-length boundary segments including orthogonal and generally straight-sided portions. A signal feed point is located at a connection locus of the two segments. Diagonal pairs of the loops have a differential feed and constitute a dipole. Thus, two diagonal pairs of the loops form the square layout, which thereby form two crossed dipoles. Cross-coupling between these two diagonally-oriented dipoles is effectively canceled, due to length, width, and spacing of segments that form the loops. Typically, a length of the perimeter length of each loop is on the order of a half wavelength. The shape of each loop is generally square. The four loops that form the two crossed dipoles are substantially identical; accordingly, the crossed dipole assembly generally has lateral and fourfold rotational symmetry.

While the concepts described above have been developed in efforts to improve antenna performance over a wide range of use, other improvements in antenna performance are desired. Specifically, for example, there is a need to improve antenna bandwidth. Further, the above-described antenna designs have a large power capability and, more particularly, have a larger power capability than is typically required for applications to which these antennas are applied. Thus, there is an additional need for antennas that have a reduced power handling capacity, as well as the above-mentioned improved bandwidth, such that production and/or manufacturing costs for, along with the size and weight of, the antennas is reduced.

BRIEF SUMMARY OF THE INVENTION

The foregoing antenna performance improvements are realized by embodiments of the present invention, which include an apparatus and method that provides a dual-input crossed dipole antenna that substantially eliminates mutual coupling between bays of a crossed dipole array, substantially eliminates cross-coupling between dipole elements within a single radiator, supports elliptical polarization, and realizes a broad bandwidth characterized by one or more frequency ranges over which the antenna exhibits a low standing wave ratio.

In one embodiment, an antenna radiator is provided. The radiator includes a pair of elements, each including a node, a first ring connected to the node, and a second ring connected to the node and disposed inside of and coplanar with the first ring. The first ring includes a first plurality of segments, and the second ring includes a second plurality of segments.

In another embodiment, an antenna includes a power divider and a plurality of radiators connected to the power divider.

There have thus been outlined, rather broadly, certain embodiments of the invention, in order that the detailed description thereof herein may be better understood, and in order that the present contribution to the art may be better appreciated. There are, of course, additional embodiments of the invention that will be described below, and which will form the subject matter of the claims appended hereto.

In this respect, before explaining one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above and other aspects and features of the present invention will become more readily apparent by describing in further detail embodiments thereof with reference to the accompanying drawings, in which.

DETAILED DESCRIPTION

Generally speaking, embodiments of the present invention provide antennas that combine a plurality of crossed dipole radiators to substantially improve bandwidth in relatively low-power transmitting systems, e.g., a bandwidth enhancement is realized by combining at least two concentric rings in each loop element of the radiators included in the antennas.

Figure 1:
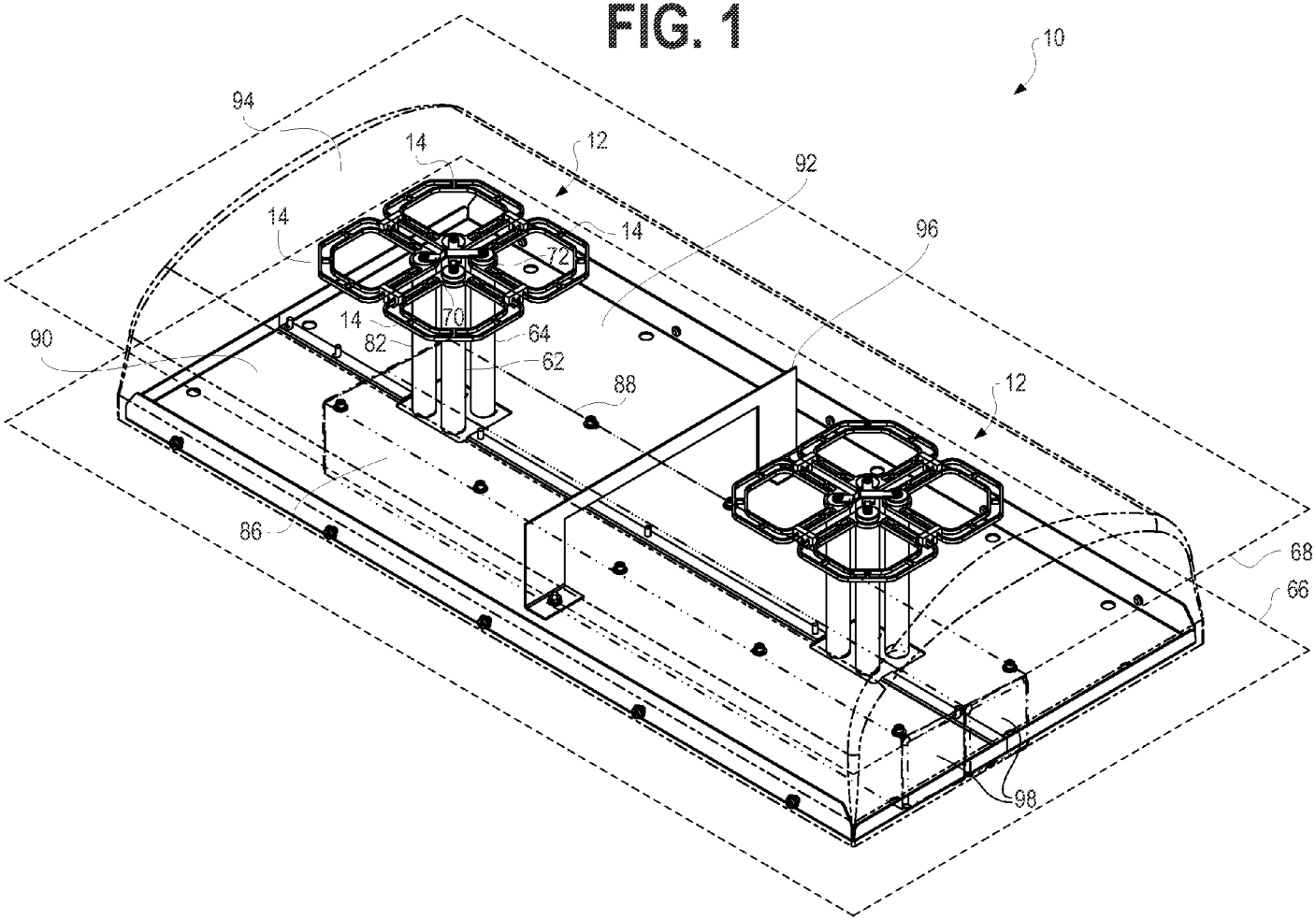
FIG. 1 depicts a perspective view of a panel antenna having radiators in accordance with an embodiment of the present invention.

FIG. 1 shows an antenna 10 having at least one radiator 12. In one embodiment, the radiator 12 is dual-loop crossed dipole radiator 12. As will be described in greater detail below, a dipole is a device that emits and/or captures energy of an electromagnetic (EM) signal. More particularly, a dipole is a device having two similarly dimensioned, spatially separated, electrically isolated conductive parts. One of the two parts has an instantaneous energy state (from the EM signal) that is different from an instantaneous energy state of the other part. The two parts of a dipole may be referred to as monopoles. For purposes of description herein, each of the crossed dipoles is described as being center-fed, e.g., differential excitation is applied to the respective monopoles proximal to a midpoint of each dipole, but it will be understood that additional embodiments are not limited thereto.

A dipole has a bandwidth over which it can transmit or receive EM signals relatively efficiently. The transmitting efficiency is a characteristic of the dipole's complex impedance matching to a source and a transmission system on a feed side, and to the dipole's coupling to free space on a radiation side. Impedance matching is commonly measured in terms of voltage standing wave ratio (VSWR), a comparison between applied and reflected signal energy measured in terms of voltages from a narrow-band, swept-spectrum transmitter to the dipole. An ideal VSWR is defined as 1.0:1; transmitting antennas with VSWR as high as 1.5:1 or greater are usable for some applications, although reflected energy must be diverted from or tolerated by the source.

Figure 2:
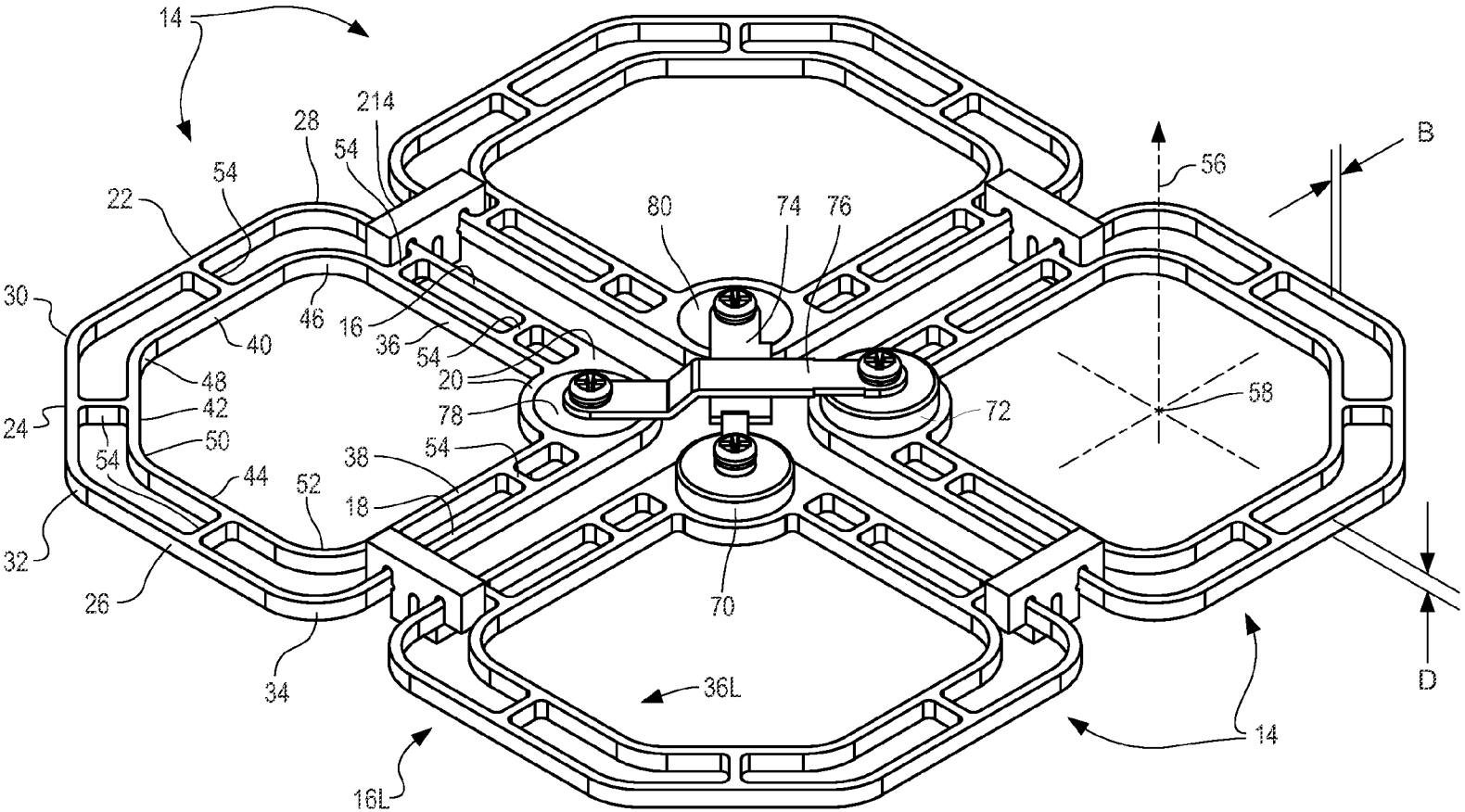
FIG. 2 depicts a perspective view of a single four-element radiator of the panel antenna of FIG. 1 in accordance with an embodiment of the present invention.

FIG. 2 shows a four-element radiator 12 in greater detail. Hereinafter, the elements 14 will be referred to as "petals" 14, in view of their outlines, and four of these petals 14 make up a four-leaf-clover-shaped crossed-dipole radiator 12, as shown in FIG. 2. Each petal 14 in the embodiment shown in FIG. 2 includes a plurality of segments. Specifically, each petal 14 includes a first plurality of segments that forms a first, e.g., outer, loop 16L and a second plurality of segments that forms a second, e.g., inner, loop 36L. More specifically, each petal includes two orthogonal straight segments 16, 18. The straight segments 16, 18 are connected to a node 20, which additionally serves as a mounting provision. A closed electrical path is completed using additional conductive material in the form of a series of straight segments 22, 24, 26 and arcs, e.g., curved segments, 28, 30, 32, 34. The path has a perimeter length that approximates a half wave of a frequency selected to be above a lower extreme of the passband of a given embodiment of the antenna 10. As shown in FIG. 2, the first, outer ring 16L includes segments 16, 28, 22, 30, 24, 32, 26, 34, 18 and 20.

The second, inner ring 36L is disposed within and approximately point-by-point parallel to the outer ring 16L. The inner ring forms an electrical path that also includes the node 20. The node 20 terminates two straight segments 36, 38, which are orthogonal to each other, of the inner ring 36L, and continues the inner ring through a second series of straight segments 40, 42 and 44 and arcs 46, 48, 50 and 52. The perimeter length of each inner ring 36L, e.g., segments 36, 46, 40, 48, 42, 50, 44, 52, 38 and 20, approximates a half-wave of a higher frequency selected to be below the upper extreme of the passband of the antenna 10.

Each two diagonally-opposed petals 14 form a dipole. Hybrid coupling between parallel straight segments 16, 18 of each two adjacent petals 14 minimizes cross-coupling within the crossed-dipole radiator 12.

Between the two rings 16L, 36L is one rib 54 or, alternatively, a plurality of ribs 54, which in one embodiment are conductive bridging ribs 54. Count and placement of the ribs 54 may vary among various embodiments. The ribs 54 connect the rings 16L, 36L, and thereby alter the mechanical resonant frequency, cancel vibratory modes and cross-couple stresses, for example, to effectively increase mechanical strength at minimal material cost. The ribs 54 further increase extrusion rigidity, in embodiments wherein the petals 14 are formed by transverse cuts from a continuous extrusion having as its profile the rings 16L, 36L, ribs 54, and node 20. The ribs 54 improve production speed and yield, e.g., faster saw blade advance without component distortion, more robust parts, etc.

Figure 3:
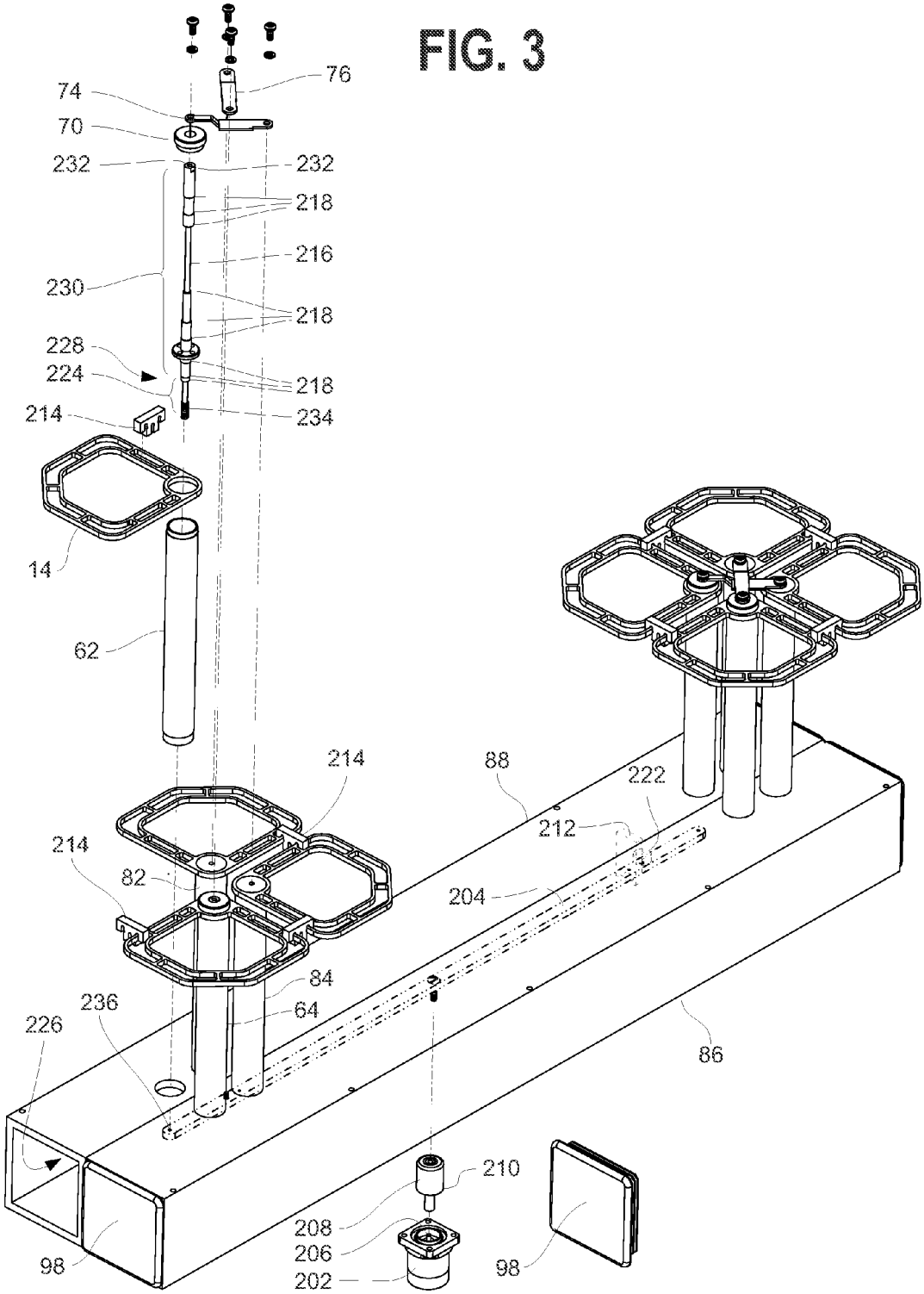
FIG. 3 depicts an exploded perspective view of certain parts of the panel assembly of FIG. 1 in accordance with an embodiment of the present invention.

In an embodiment, an antenna 10 may be wholly lacking the ribs 54. In other embodiments, intermediate numbers of the ribs 54, such as the number shown in FIGS. 1-3, are included. In yet another embodiment, a sufficiently large number of the ribs 54, e.g., a number approaching what substantially forms a continuous body, instead of the two distinct rings 16L, 36L, may be included, although a continuous or near-continuous, e.g., many ribs 54, structure behaves as a single, thick-bodied radiator, that exhibits broader bandwidth and higher VSWR than a thin-bodied radiator.

Returning again to FIG. 1, the signal feed to each radiator 12 uses two unbalanced feed lines. Each of the unbalanced lines terminates in a quarter-wavelength coaxial section, of which coaxial outer conductors 62, 64 are visible in FIG. 1. Each terminal coaxial outer conductor 62, 64 is conductively mounted to a petal 14, and to a common conductive surface 66, the latter functioning as a reflective ground plane, distal to the plane 68 of the petals 14. A quarter-wavelength spacing between the respective planes 66, 68 causes the short circuit path connecting the coaxial outer conductors 62, 64 at the ground plane 66 to appear as an open at the petal plane 68, and thus to be non-loading over a design frequency range.

Returning to FIG. 2, coaxial inner conductors (not visible in the views of FIGS. 1 and 2) traverse insulating passthrough fittings 70, 72 that cap the coaxial outer conductors 62, 64. Feed straps 74, 76 connect the inner conductors to conductive terminal fittings 78, 80 that attach to the remaining petals 14.

Returning to FIG. 1, support tubes 82, 84 (support tube 84 best shown in FIG. 3) can be unpopulated, e.g., empty, coaxial outer conductor parts; they attach their respective petals 14 to the ground plane 66 in the same fashion as the coaxial outer conductors 62, 64. The petals 14 distal to the coaxial outer conductors 62, 64 therefore are the actively driven elements, while the petals 14 that are affixed to the coaxial outer conductors 62, 64 are referred to ground potential.

All four petals 14 are isolated at their working frequencies by their spacing from the ground plane 66, and by the feed method, and thus make up two orthogonal, balanced dipoles, despite being driven from unbalanced coaxial lines. The four coaxial outer conductors/support tubes 62, 64, 82, 84 (tube 84 best shown in FIG. 3), the two inner conductors, and the feed straps 74, 76 are thus properly termed balanced-to-unbalanced transformers, or baluns. In an embodiment, the instantaneous voltage differential between each two petals 14 predominates in emission. The primary uses of the baluns are allowing coaxial lines to carry single-ended signals to the balanced dipoles, and preventing signal current and therefore signal emission in the shielded or grounded portions of the apparatus. Note that the term "transformer" as used herein refers not only to the overall function of the baluns, but also with reference to step diameter changes in the balun inner conductors—both in free space and within the baluns—as well as for coaxial connector inner conductor extensions that also feature step diameter changes and for small, button-shaped "slug" fittings attached to the striplines. Each such step causes impedance changes that can be modeled as transformers.

The four petals 14 and the four tubes 62, 64, 82, 84 (FIGS. 1 and 3) may each be described as having a substantially rectilinear or square layout, since their respective layouts exhibit fourfold rotational symmetry. The tubes 62, 64, 82, 84 (FIGS. 1 and 3) terminate at the parallel ground plane 66 and petal plane 68, and are thus coextensive.

The ground plane 66 in the embodiment of FIG. 1 is realized using a pair of box-section conductive tubes 86, 88 (best shown in FIG. 3), functioning as strength members, and of which the interiors function as stripline ground reference chambers for signal distribution. Affixed to the box-section tubes 86, 88 and, like the tubes, spaced approximately a quarter-wavelength away from the plane 68 of the petals 14, a broader, light-gauge backplane 90, 92 is attached. The backplane 90, 92 in the embodiment shown is assembled of two major components, excluding fastenings, primarily to ease assembly around two pressed-together subassemblies of petals 14 and support tubes 62, 64, 82, 84 (FIGS. 1 and 3) onto joined box-section tubes 86, 88. Other embodiments may be substituted; the one shown locates the backplane 90, 92, a radome 94, and a backplane-mounted signal isolator 96, reducing mutual coupling between the two assemblies of radiators 12; referred to descriptively as a "goal post," in positions that are practical for a production-oriented dual-radiator directional panel antenna embodiment according to the invention. In the embodiment shown, the box-section tubes 86, 88 are each square, and are welded into a single duct unit in an intermediate manufacturing step. In other embodiments, in place of discrete tubes may be signal distribution ducts that are chambers in a single extrusion or a composite of pieces other than individual square tubes, may be tubes connected together with screws or other hardware instead of being welded, may be non-square or non-rectangular, may be integral with or serve as part of a backplane, etc.

Comparatively weather resistant embodiments may be preferable. Resilient end caps 98, shown fitted onto the tubes 86, 88, can be effective over extended periods of service. Such caps 98 can tolerate direct exposure to harsh weather, even relying only on their seal design. If material compatibility is assured, seal performance may be enhanced by application of adhesive sealant. Such caps 98 can be removed or replaced; this may permit antenna assembly and maintenance without recourse to welding or metal cutting after press fitting and screw installation, for example, in contrast to configurations with welded-on metallic end caps. In alternative configurations, a top end cap may be a welded plate, providing a permanent seal, while the bottom is left open to assure drainage of condensation, is closed with a resilient cap to ease assembly, is capped but includes a weep hole, etc.

In the following discussion, the two radiators 12 of FIG. 1 are configured to operate with one directly above the other, pointing nearly horizontally, so that the chambers of the tubes 86, 88 are vertical, side-by-side, and open at top and bottom. This causes a beam from the antenna to be flattened in elevation. Each radiator 12 includes two feeds 62, 64; the signals for these may be applied in parallel to any number of radiators 12 on a single backplane 90, 92 as shown. If the signals applied to the feeds 62, 64 of the respective radiators 12 are substantially identical, and are, upon reaching the respective feeds 62, 64, in phase, then the output is a single signal with linear, vertical polarization. If the signals are identical but 180 degrees out of phase at the respective feeds 62, 64, then the output is a single signal with linear, horizontal polarization. If the signals are identical, but one lags the other by 90 degrees at the respective feeds 62, 64, in an otherwise symmetrical embodiment, then the output is a single signal with circular polarization. The lag can be realized by interposing into one of the two feed paths a phase shifter or, equivalently, a feed line that differs in length from the other by a critical amount, dependent on the propagation speed in the feed line for the frequency in use. The handedness of the radiated signal is determined by which input lags. If the later signal is delayed by an amount different from 90*n degrees, where n=0, 1, 2, 3 . . . , then the polarization is elliptical. Similarly, if the amplitudes of the two signals differ, polarization is a function of phase and relative amplitude.

If the arrangement is as above, but the signals are uncorrelated, then the output is two linear, orthogonal signals, each having polarization tilted 45 degrees from the vertical. This applies either for two same-channel signals with different intelligence, or for unrelated signals on different channels, although in the former case greater attention to suppression of interference may be required. This concept can be extended to applying two distinct signals to an external 3 dB coupler, in which case the coupler outputs, fed to the radiator inputs with proper phasing, can cause emission of two output signals of opposite circular polarization.

FIG. 3 is a partially exploded view of the dual-radiator embodiment 10 shown in FIG. 1, and provides more detail regarding the feed system referenced above.

In the embodiment shown, coaxial connectors 202 provide signal connection to external cabling (not shown). Coaxial connector 202 characteristic impedance, such as 50 ohms, for example, may be mismatched for signal distribution to a stripline 204 (shown in phantom) to which the connector inner conductor 206 is coupled. This can be corrected in some embodiments using inner conductor extensions 208 having one or more step diameter changes 210 that provide impedance matching. The extensions 208 also function as fittings to position the stripline 204, along with insulating spacers 212, of which the style shown (also shown in phantom) is representative.

The petals 14 are mechanically linked to one another using any appropriate style of insulating clamp fittings or clips 214 (also shown in FIG. 2); typical is a shape such as that shown, made from a low-loss, relatively low dielectric constant, somewhat resilient material such as polytetrafluoroethylene (PTFE), polyethylene (PE), or the like, reinforced or otherwise, foamed or solid, as preferred for an application. As with any solid material in a radiation field, there is some effect on signal propagation responsive to the location, mass, loss tangent, and dielectric constant of the clips 214; for small numbers of low-mass, low-dielectric-constant clips 214 such as those shown, the effect may be negligible.

The balun inner conductor 216 is one of the components referenced above as not visible in FIG. 1. The step diameter changes 218 establish a series of impedance changes readily modeled as transformers. These adapt the impedance of the flat stripline 204, itself impedance-adapted using a tuning slug 222 (shown in phantom), to the part 224 of the balun inner conductor 216 fitted inside the chamber 226 defined by the square tube outer conductor 86. In the chamber 226 environment, the part 224 approximates the impedance of a single conductor in free space. The steps 218 then provide impedance transition 228 to an inner conductor 230 within an outer coaxial conductor 62. The last of steps 218 establish terminating impedance at a feed strap 74.

In some embodiments, the inner conductors 216 in the two baluns can be identical components. This is facilitated if the conductors 216 are attached to matching stripline 204 terminations, if they transition to coaxial form at the same point 228, and if they terminate at the same impedance to respective feed straps 74, 76. Feed straps 74, 76 have different impedance environments, the first strap 74 being proximal to petals 14 and balun tubes 62, 64 on one side and proximal to the second strap 76 on its other side, the second strap 76 proximal to the first strap 74 on one side and substantially open to free space on its other side. In some embodiments, the feed straps 74, 76 can be modeled and dimensioned as dissimilar striplines. As a design option, the feed strap 74, 76 impedances, with reference to the balun inner conductors 216, may both be 50 ohms or another convenient value as connected to identical balun inner conductors 216, or may appear as equal, such as 50 ohms, etc., impedances at the point of attachment to the driven petals 14. In other embodiments, impedance values may differ at all points, with design validity based on coaxial connector 202 input impedance and far field signal properties. In some embodiments, flats 232 may be included with minimal electrical effect to allow balun inner conductors 216 with screw threads 234 to be screwed into threaded holes 236 in the striplines 204 with readily controlled torque. The combination of flats 232 and screw threads/threaded junctions 234/236 is one of a variety of assembly options, and should not be viewed as limiting.

Parallel conductor extensions 208, the connector inner conductor extensions, and parts 224, of the balun inner conductors 216, in the chambers 226 are approximately a half-wavelength apart in typical embodiments. Such conductors 208, 224 may act as resonators, coupling a portion of the applied signal energy separately from the conductive transmission realized via the stripline 204. In view of element orientation and relative signal propagation velocities in the stripline 204 and free space within the chambers 226, the conductors 208, 224 may cause measurable phase shift or attenuation in the coupled signal.

Figure 4:
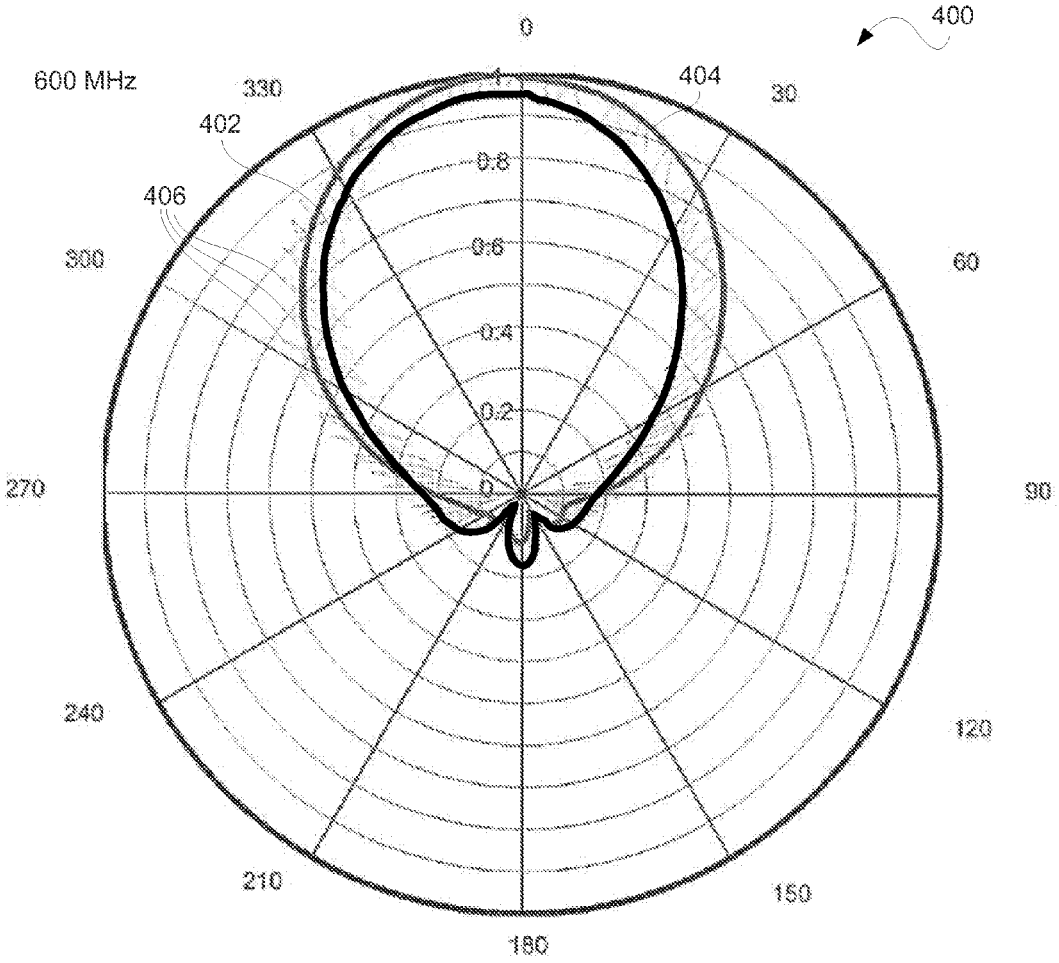
FIG. 4 is a polar graph of axial ratio and horizontal and vertical gain versus azimuth depicting a propagation pattern of the panel antenna of FIG. 1.

FIG. 4 presents, in polar chart 400 form, measured far-field signal strength versus azimuth for a dual-radiator antenna 10, such as the embodiment of the antenna 10 shown in FIG. 1 and described in greater detail above. As is typical in measuring performance of antennas 10 capable of circular polarization, the antenna 10 is affixed to a platform that is rotatable about a vertical axis and fed signals suited to causing circularly polarized emission, while the antenna 10 is repeatedly rotated through all azimuths. A calibrated, single-polarization receiving antenna in far field at about the same height as the antenna 10 under test is successively held fixed in a vertical orientation, held fixed in a horizontal orientation, and rotated relatively rapidly about an axis directed toward the antenna 10 under test, as the antenna 10 rotates relatively slowly through all azimuths. The chart 400 shows the received far-field signal strength when the calibrated antenna is vertically oriented 402, horizontally oriented 404, and rotating 406. The ratio of signal strength in the vertical 402 to horizontal 404 at each azimuth is a rough measure of axial ratio, assuming axial tilt to be zero. As stated above, the signal 406 from the rotating receiving antenna samples intermediate angles over all azimuths. The maximum and minimum excursions of the voltage trace at each azimuth define two curves similar to the vertical and horizontal axis measurements, but more accurately correspond to the relative magnitudes of the major axis and minor axis components of the polarization ellipse at that azimuth, and thus the axial ratio. For acquiring the data in this test chart 400, there was a 90 degree phase lag for one feed with respect to the other, with signals of equal strength applied to the respective inputs.

Figure 5:
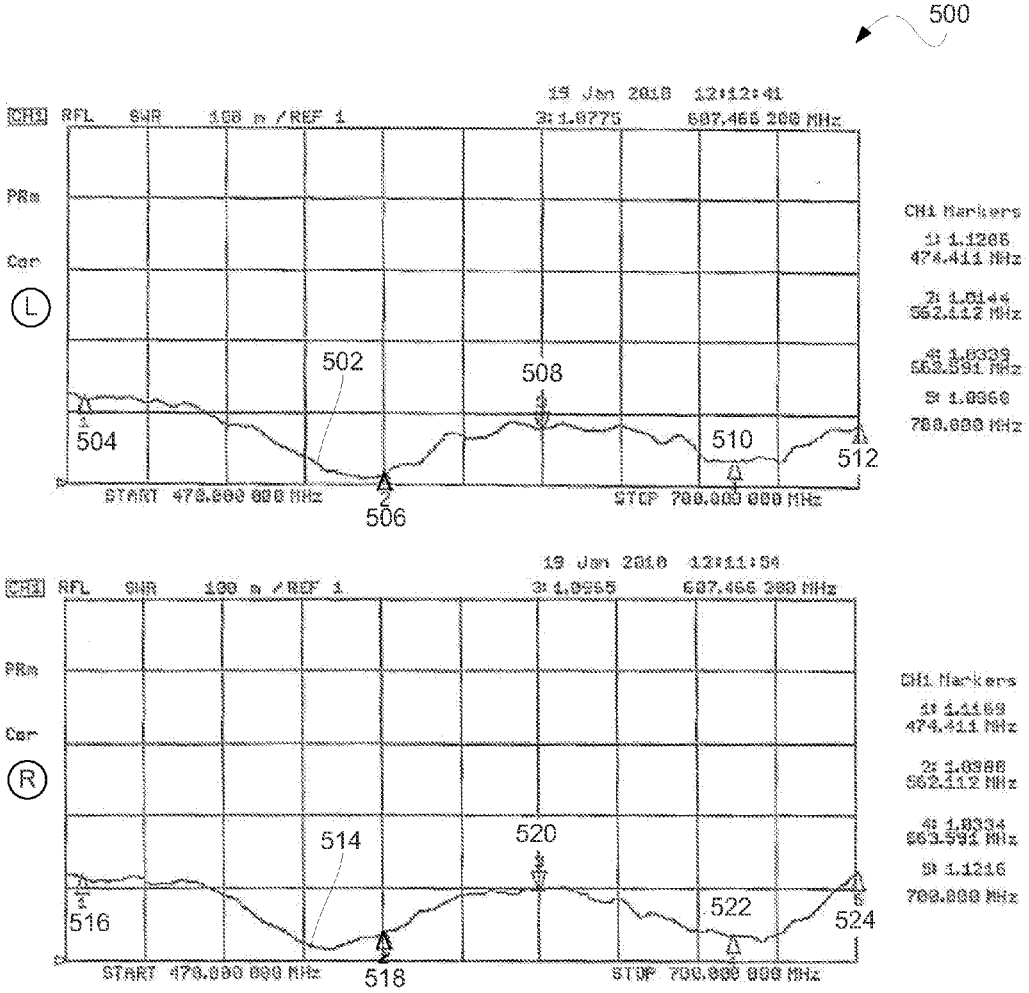
FIG. 5 includes a pair of graphs of frequency versus voltage standing wave ratio (VSWR) depicting performance of an antenna in accordance with an embodiment of the present invention.

FIG. 5 presents, in a pair of charts 500 using rectangular coordinates, the VSWR of the antenna 10 tested in FIG. 4. A trace 502 shows VSWR versus frequency for the left input connector, and thus for the two baluns driven from one stripline 204. Markers at representative frequencies 504, 506, 508, 510, and 512 indicate the beginning of a test instrument sweep 504, a VSWR value 506 near the lower-frequency minimum associated with the outer ring 16L, a VSWR value 510 near the higher-frequency minimum associated with the inner ring 36L, an intermediate frequency marker 508, located between the minima 506, 510 and associated with a transition from outer-ring 16L to inner-ring 36L dominance, and an end-of-run marker 512.

The second trace 514 repeats the above measurements for the right input connector. Markers 516, 518, 520, 520, 522, and 524 show measurement frequencies for this test; again, the as-realized minima are close (546 MHz, 669 MHz) to the estimated points 518, 522 (562 MHz, 664 MHz).

The particular embodiment constructed, tested, and presented in the charts of FIGS. 4 and 5 has individual petals about 4 inches (10 cm) across and is intended for use within the frequency range 470 MHz to 698 MHz (U.S. UHF TV channels 14-51), which corresponds to the testing presented in the chart 400 and 500 data.

Assembly of the various tubes to the petals 14 may likewise admit of methods other than pressure, interference, fit in some embodiments. The use of extruded aluminum for at least the pressed-together components, e.g., tubes, petals, specifically, a single alloy well-suited to extrusion and pressure assembly, may aid in preserving electrical and mechanical integrity. In alternative embodiments, fastening by welding, such as aluminum, etc., soldering, e.g., brass, copper, etc., brazing, e.g., cuprous, ferrous, etc., conductive adhesives, carbon fiber, etc., screw assembly, etc., may be preferred.

The geometries are readily scalable at least down to VHF and up to microwave portions of the communications spectrum. A constraint at lower frequencies is the capability of existing extrusion equipment to produce shapes of large size that include the complexity and precision indicated. This may be obviated by fabricating the petals 14 without extrusion, such as by cutting or punching from sheet stock, or bending and welding from strip stock, etc. The square tubes or equivalent 86, 88 are simpler and may be smaller, as are the balun outer conductors/support tubes 62, 64, 82, 84; these components are not constraining except at much lower frequencies, and are less critical regarding shape than are the petals 14.

For higher frequency embodiments, smaller components are used. These are closer spaced and thus potentially voltage limited to lower power levels than those usable at lower frequencies. For sufficiently high frequencies, circuit board fabrication methods may be applied for at least some of the components making up antennas according to the invention.

It is readily observed that the minima in the vicinity of the markers 506, 510, 518, 522 occur at frequencies associated with their respective perimeter dimensions, that each provides a distinctly low VSWR, varying gradually over a range of frequencies, and that the minima are separated by a frequency range exhibiting a VSWR that is slightly higher, but nonetheless low by comparison to many other styles of radiator. In view of the low VSWR realized throughout a range extending from below the lower minimum 506 to above the upper minimum 510, a user may elect to use any frequency over this range without altering the extrusion or feed system, application requirements permitting.

It is to be noted that the breadth of each minimum, defined generally as the range over which the VSWR remains below a selected threshold, is a function of the physical spacing between the two rings 16L, 36L in each petal 14. For the embodiment shown, over the tested range 474 MHz to 700 MHz, the left-side string baseline VSWR for the radiator assembly alone starts at 1:1.12, dipping below 1:1.05 from about 529 MHz to about 569 MHZ and again from about 647 MHz to about 682 MHz. Thus, if a user's criterion is a VSWR below 1:1.05, those two ranges apply, while a VSWR below 1:1.1 yields a range from about 509 MHz to about 693 MHz, and a VSWR criterion relaxed to 1:1.15 includes the entire UHF television broadcast range and some amount beyond.

An additional factor in the broadening properties of the antenna 10 according to one embodiment is the coupling between the higher-frequency rings 36L in adjacent petals 14. This includes signal coupling indirectly by way of the lower-frequency ring 16L—that is, the higher-frequency signal is coupled from each higher-frequency ring 36L to the lower-frequency ring 16L in the same petal 14, then to the adjacent part of the lower-frequency ring 16L in the adjacent petal 14, and finally to the higher-frequency ring 36L in the adjacent petal 14. In extending the frequency range upward, the size of the higher-frequency rings 36L becomes smaller, and the average physical gap between the rings 36L and 16L of respective petals 14 increases. This may cause a decrease in the useful property of cancellation of cross-coupling between dipoles in some embodiments.

Yet another factor is the conformal shape of the rings 16L, 36L to one another. In the embodiment shown in FIGS. 1-3, ring 16L, 36L spacing is slightly less conformal at some points, although the rings are individually smoothly curved throughout, and the gap variation is likewise smooth. This tends to broaden frequency response, raising the minimum values of VSWR in proportion to the extent to which ring spacing is non-uniform.

The depth D and breadth B of the conductive material making up each ring 16L, 36L, i.e., the dimensions in a propagation direction 56 and generally radially from a centroid 58 of each petal 14, as shown in FIG. 2, are selected independently, and affect overall performance in different ways. Depth affects at least stiffness, weight, material cost, impedance, and bandwidth, the first by increasing beam thickness, the last by making the distance from the petal 14 to the backplane 90, 92 less sharply defined. Breadth has a lesser effect on stiffness, as a first-power rather than third-power function, but equally affects weight and material cost. Effect of breadth on bandwidth includes factors such as skin depth conductivity, increase of bandwidth with the range of frequencies for which a half-wave resonant signal path within the ring exists, and interaction between rings as gaps therebetween decrease, assuming innermost and outermost perimeters are held constant.

In additional embodiments, the number of nested, approximately concentric rings may be increase beyond two. The net effect of such an evolution is to further flatten the VSWR over the antenna's working range. Making room for the additional rings and the gaps between rings, while retaining the coupling gap between petals 14, raises the upper limit for the antenna if the lower limit is fixed, and increases the overall size of each petal 14 and thus the entire antenna if the lower limit is allowed to extend downward in frequency. Other considerations in this process include the value of extending the frequency range of the antenna, in view of government-mandated and licensed spectrum assignments. Along the same track, antenna dimensions are constrained by the baluns, which are tuned lengths of conductor that define signal path termination properties and fix petal 14 location with respect to the backplane 90, 92.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those of ordinary skill in the art, it is not desired to limit the invention to the exact construction and operation illustrated and described, and accordingly, all suitable modifications and equivalents may be resorted to that fall within the scope of the invention, as defined by the following claims.

What is claimed is:

1. A radiator, comprising:

four elements forming a crossed dipole, each element including:

a node;

a first ring, connected to the node, including a first plurality of segments;

a second ring, connected to the node and disposed inside of and coplanar with the first ring, including a second plurality of segments; and at least one rib connecting the first ring to the second ring.

2. The radiator of claim 1, wherein planes tangential to points along the second ring of each element are substantially parallel to planes tangential to corresponding points of the first ring along respective perimeters of the first and second rings.

3. The radiator of claim 2, wherein said first and second pluralities of segments include straight segments and curved segments, said straight segments and curved segments connected to each other to form the first and second rings.

4. The radiator of claim 3, wherein the at least one rib connects straight or curved segments of the first ring to corresponding straight or curved segments, respectively, of the second ring.

5. The radiator of claim 1, wherein a node terminal fitting is connected to the node to supply the node with an excitation signal from a feed strap.

6. The radiator of claim 1, wherein a voltage standing wave ratio of the radiator is about 1:1.05 or lower for a first frequency range of about 529 megahertz to about 569 megahertz and a second frequency range of about 647 megahertz to about 682 megahertz.

7. An antenna, comprising:

a power divider; and a plurality of radiators connected to the power divider, each radiator including four elements forming a crossed dipole, each element including:

a node;

a first ring, connected to the node, including a first plurality of segments; and a second ring, connected to the node and disposed inside of and coplanar with the first ring, including a second plurality of segments, wherein each element includes at least one rib connecting the first ring to the second ring.

8. The antenna of claim 7, wherein planes tangential to points along the second ring of each element are substantially parallel to planes tangential to corresponding points of the first ring along respective perimeters of the first and second rings.

9. The antenna of claim 8, wherein said first and second pluralities of segments include straight segments and curved segments, said straight segments and curved segments connected to each other to form the first and second rings.

10. The antenna of claim 9, wherein the at least one rib connects straight or curved segments of the first ring to corresponding straight or curved segments, respectively, of the second ring.

11. The antenna of claim 7, further comprising feed straps connected to the respective nodes of the elements to supply an excitation signal to the elements.

12. The antenna of claim 11, further comprising a dual-balun feed network connected to the power divider to supply the excitation signal to the elements.

13. The antenna of claim 12, wherein the dual-balun feed network includes:

a first outer conductor conductively terminated at the node of a first element of the four elements;

a first inner conductor disposed within the first outer conductor, conductively terminated at the node of a second element of the four elements, the second element disposed diagonally opposite the first element;

a second outer conductor terminated at the node of a third element of the four elements;

a second inner conductor disposed within the second outer conductor, conductively terminated at the node of a fourth element of the four elements, the fourth element disposed diagonally opposite the third element, wherein the first and second inner conductors are electrically isolated from each other, and the first and second outer conductors electrically connected to each other.

14. The antenna of claim 13, wherein diameters of the first and second inner conductors vary in step increments along respective lengths thereof.

15. The antenna of claim 7, further comprising a radome.

16. The antenna of claim 7, wherein a voltage standing wave ratio of each of the radiators is about 1:1.05 or lower for a first frequency range of about 529 megahertz to about 569 megahertz and a second frequency range of about 647 megahertz to about 682 megahertz.

17. An element for a crossed dipole radiator, comprising:

a node;

a first ring, connected to the node, including a first plurality of segments;

a second ring, connected to the node and disposed inside of and coplanar with the first ring, including a second plurality of segments; and at least one rib connecting the first ring to the second ring.

18. The radiator of claim 1, wherein the at least one rib connecting the first ring to the second ring comprises a plurality of ribs.

19. The antenna of claim 7, wherein the at least one rib connecting the first ring to the second ring comprises a plurality of ribs.

20. The element of claim 17, wherein the at least one rib connecting the first ring to the second ring comprises a plurality of ribs.

* * * * *